US006997766B1

(12) United States Patent
Brogdon et al.

(10) Patent No.: US 6,997,766 B1
(45) Date of Patent: Feb. 14, 2006

(54) MARINE ENGINE SUPER FLUSHING AND CORROSION CONTROL SYSTEM

(76) Inventors: Douglas O. Brogdon, 2314 Beech St., Panama City Beach, FL (US) 32408; Thomas W. Watts, 2714 Princess La., Panama City Beach, FL (US) 32405

( * ) Notice: Subject to any disclaimer, the term of this patent is extended or adjusted under 35 U.S.C. 154(b) by 0 days.

(21) Appl. No.: 11/125,667

(22) Filed: May 10, 2005

(51) Int. Cl.
*B63H 21/10* (2006.01)

(52) U.S. Cl. ..... 440/88 N

(58) Field of Classification Search ..... 440/88 N; 134/166 R, 169 R; 137/624.14
See application file for complete search history.

(56) References Cited

U.S. PATENT DOCUMENTS 3,568,716 A * 3/1971 Heitzman ..... 137/624.14
5,362,266 A 11/1994 Brogdon
5,393,252 A 2/1995 Brogdon
5,441,431 A 8/1995 Brogdon
5,655,937 A 8/1997 Brogdon
5,679,038 A * 10/1997 Neisen et al. ..... 440/88 R
5,980,342 A 11/1999 Logan et al.
6,776,677 B1 8/2004 Knapp, Jr.

* cited by examiner

*Primary Examiner*—Ed Swinehart
(74) *Attorney, Agent, or Firm*—J. Wiley Horton

(57) ABSTRACT

A marine engine flushing system for super flushing the cooling system of a marine engine comprising an off-axis inlet port for receiving the flow of fresh water, a rotary distribution cylinder, and a plurality of axial outlet ports for proportionately discharging the flow of fresh water. The rotary distribution cylinder provides enhanced hydrodynamic forces that help break up salt and mineral deposits in a fashion superior to all existing methods.

20 Claims, 7 Drawing Sheets

MARINE ENGINE SUPER FLUSHING AND CORROSION CONTROL SYSTEM

BACKGROUND OF THE INVENTION

1. Field of the Invention

The present invention relates to a fresh water flushing system for marine engines, and in particular to a fresh water flushing system that expels entrained sea water from a raw sea water cooling conduit of the marine engine whether the boat is in the water or out of the water, and irrespective of whether the engine is running or is shut off.

2. Description of the Related Art

Throughout the United States efforts are being taken to improve fresh water flushing systems for marine engines. Engine manufacturers universally recommend fresh water flushing. Flushing fresh water in a marine engine prolongs the life of the equipment, lowers the maintenance cost, and protects the significant investment in the engine itself.

Current systems treat marine engine cooling systems as a single cavity, as opposed to a group of cavities, water pathways, and equipment. These systems typically pump fresh water through a single conduit into the engine cooling system. Additionally, current flushing systems generally operate by the simple circulation of fresh water through the cooling system at relatively constant pressure. These systems rely on the hydrodynamic forces of steady-state circulation to purge the salt and sediment from the cooling system. This simplistic approach to flushing a marine engine's cooling system is often ineffective, resulting in the relocation of salt and mineral residues to other locations within the cooling system rather than expelling them.

Furthermore, traditional flushing systems currently available are time consuming, complicated and ineffective at removing salt buildup. Also, the current flushing systems have limitations on convenience and reliability.

Accordingly, it would be beneficial to have a fresh water flushing system that proportions and controls the flow of fresh water to each subsystem and component of the cooling system to ensure effective removal of harmful minerals, salts, and other residues from the cooling system. It would also be beneficial to deliver enhanced hydrodynamic forces during the flushing of the cooling system for optimal purging.

BRIEF SUMMARY OF THE INVENTION

The present invention is a marine engine flushing system comprising an off-axis inlet port for receiving the flow of fresh water, a rotary distribution cylinder, and a plurality of axial outlet ports for proportionately discharging the flow of fresh water. The rotary distribution cylinder provides enhanced hydrodynamic forces that help break up salt and mineral deposits.

The preferred embodiment employs a control panel mounted on an interior of the boat, a freshwater supply connection, and a control valve for regulating the flow of fresh water there through. The distributing unit for the flushing system also includes a turbine assembly which includes an impeller, a plurality of inlet ports, a rotary distribution cylinder, and a plurality of metering discharge ports. Flexible hoses can be attached from the axial outlet ports to strategic locations within the engine's cooling system for optimal purging.

REFERENCE NUMERALS IN THE DRAWINGS

| | |
|---|---|
| 10 distributing unit | 12 main body |
| 14 plug | 16 inlet fitting |
| 18 turbine assembly | 20 impeller |
| 22 distribution cylinder | 24 axial outlet ports |
| 26 hose barbs | 28 metering discharge ports |
| 30 impeller blades | 32 impeller entry ports |
| 34 main body interior | 36 inlet port |
| 38 control valve | 40 sea water pick-up pump |
| 42 thermostat housing | 44 first tuned exhaust header |
| 46 second tuned exhaust header | 48 outlet hoses |
| 50 mating wall | 52 turbine head |
| 54 turbine interior | 56 distribution cylinder |
| 58 blade face | 60 fresh water source |

DETAILED DESCRIPTION OF THE INVENTION

Figure 1A:
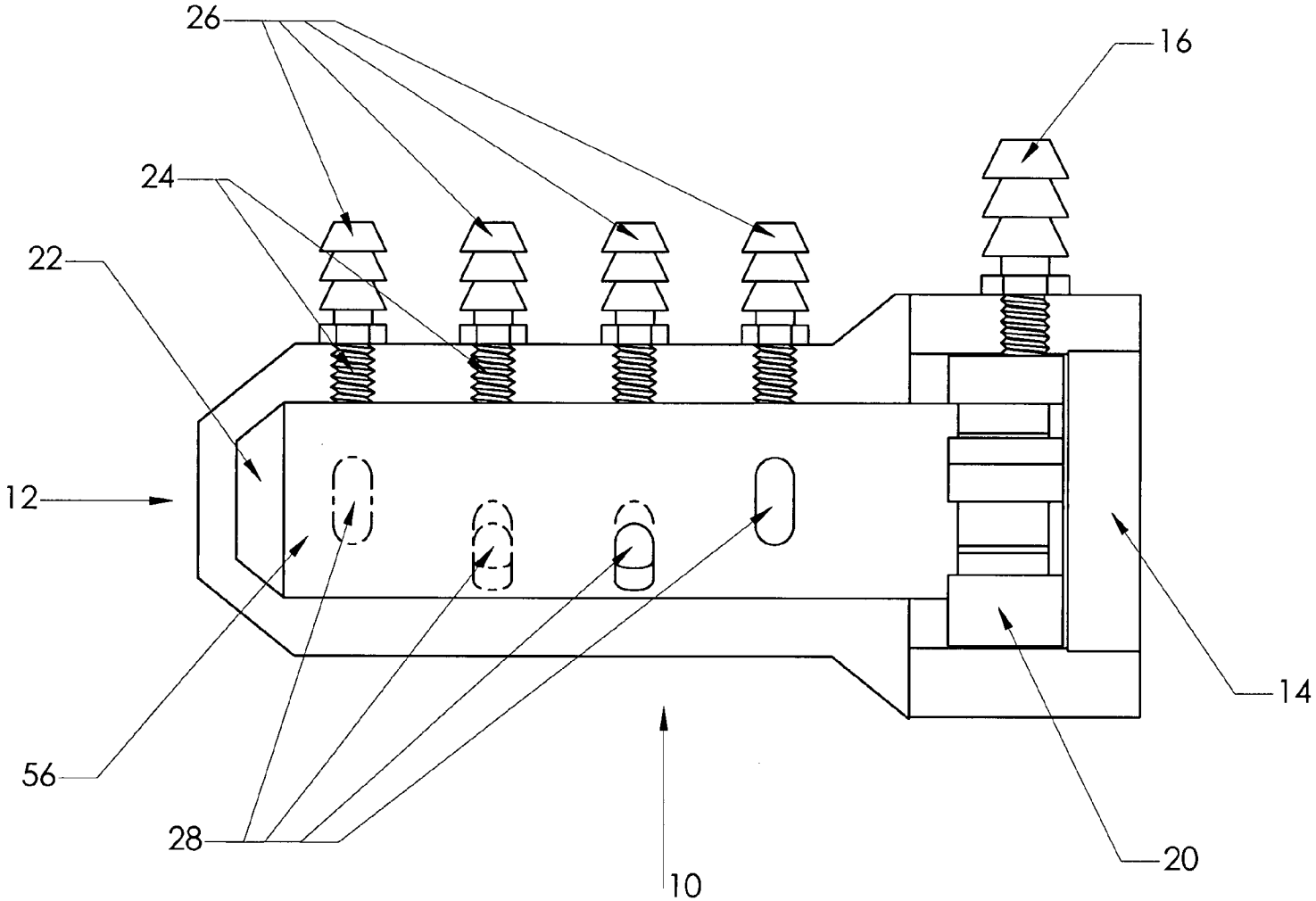
FIG. 1A is a section view, showing the present invention.
Figure 1B:
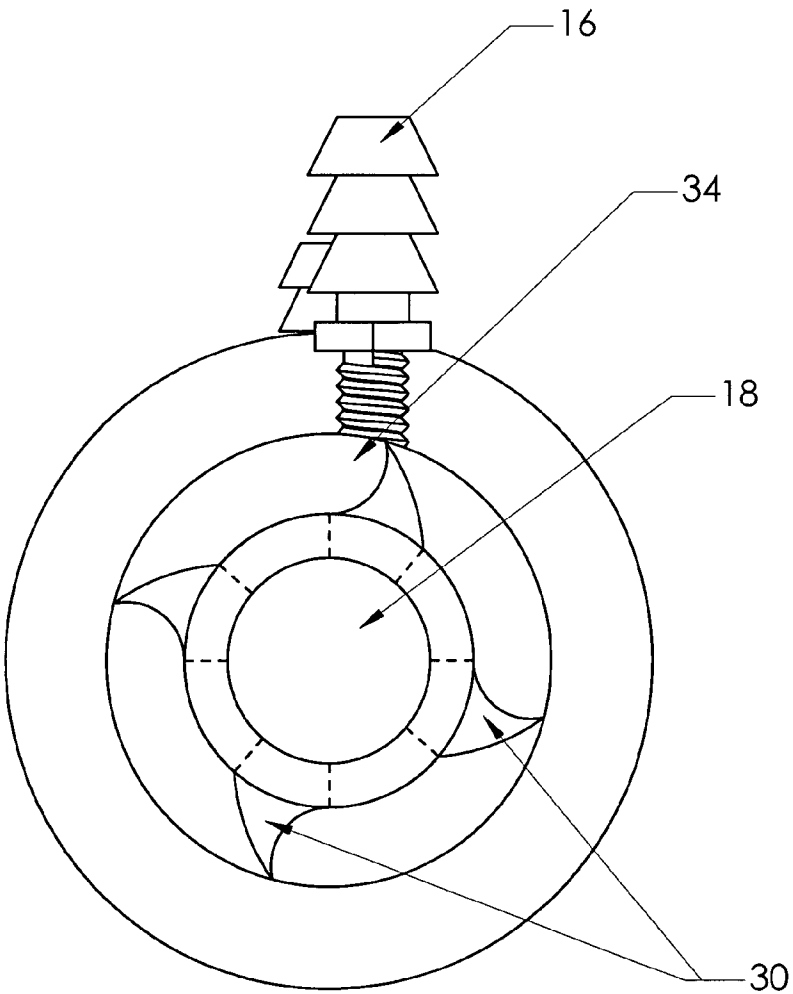
FIG. 1B is a section view, showing the present invention.

The external and internal components of a distributing unit for use in a marine engine super flushing and corrosion control system are shown in FIGS. 1A and 1B. FIG. 1A shows distributing unit 10 from the side. FIG. 1B shows distributing unit 10 from the end. Distributing unit 10 is generally composed of main body 12 and plug 14 which are used to enclose turbine assembly 18. Main body 12 has inlet port 36 which is positioned in an off-axis orientation as seen in FIG. 1B. This off-axis orientation helps turn turbine assembly 18 as will be explained subsequently. Main body 12 also has a plurality of axial outlet ports 24. Although four axial outlet ports 24 are shown in FIG. 1A, any number can be used. A range of two to eight is believed to be optimal, but the preferred number of outlet ports depends on the type and size of the marine engine and cooling system for which the flushing and corrosion control system is to be used.

Inlet fitting 16 is attached to main body 12 at inlet port 36, and hose barbs 26 are attached at each axial outlet port 24. Inlet fitting 16 and hose barbs 26 can be screwed in place. Additionally, although inlet fitting 16 and hose barbs 26 are illustrated with "barbs," other fastening means can be used to attach hoses or other forms of piping to distributing unit 10. For example, screw-on hoses and threaded fittings could also be used.

Turbine assembly 18 is contained within main body 12. Impeller blades 30 of turbine assembly 18 are positioned next to off-axis inlet port 36 so that fluid flow through inlet port 36 against impeller blades 30 causes turbine assembly 18 to spin inside main body 12. Water enters turbine interior 54 of turbine assembly 18 through impeller entry points 32 (illustrated in FIG. 2).

Referring back to FIG. 1A, turbine assembly 18 features a plurality of metering discharge ports 28. Metering discharge ports 28 are positioned along distribution cylinder 56 so that when the assembly spins each metering discharge port 28 alternates into alignment with corresponding axial outlet port 24, thereby discharging a volume of water through each axial outlet port for each rotation of turbine assembly 18. This particular feature allows for maximum fluid pressure to be discharged through each axial outlet port 24 in alternating fashion. The cyclical timing of fluid flow through each axial outlet port 24 also provides enhanced hydrodynamic forces. The oscillating pressure sequences through each axial outlet port 24 creates a non-constant fluid velocity profile which helps break down salt and mineral deposits.

Figure 2:
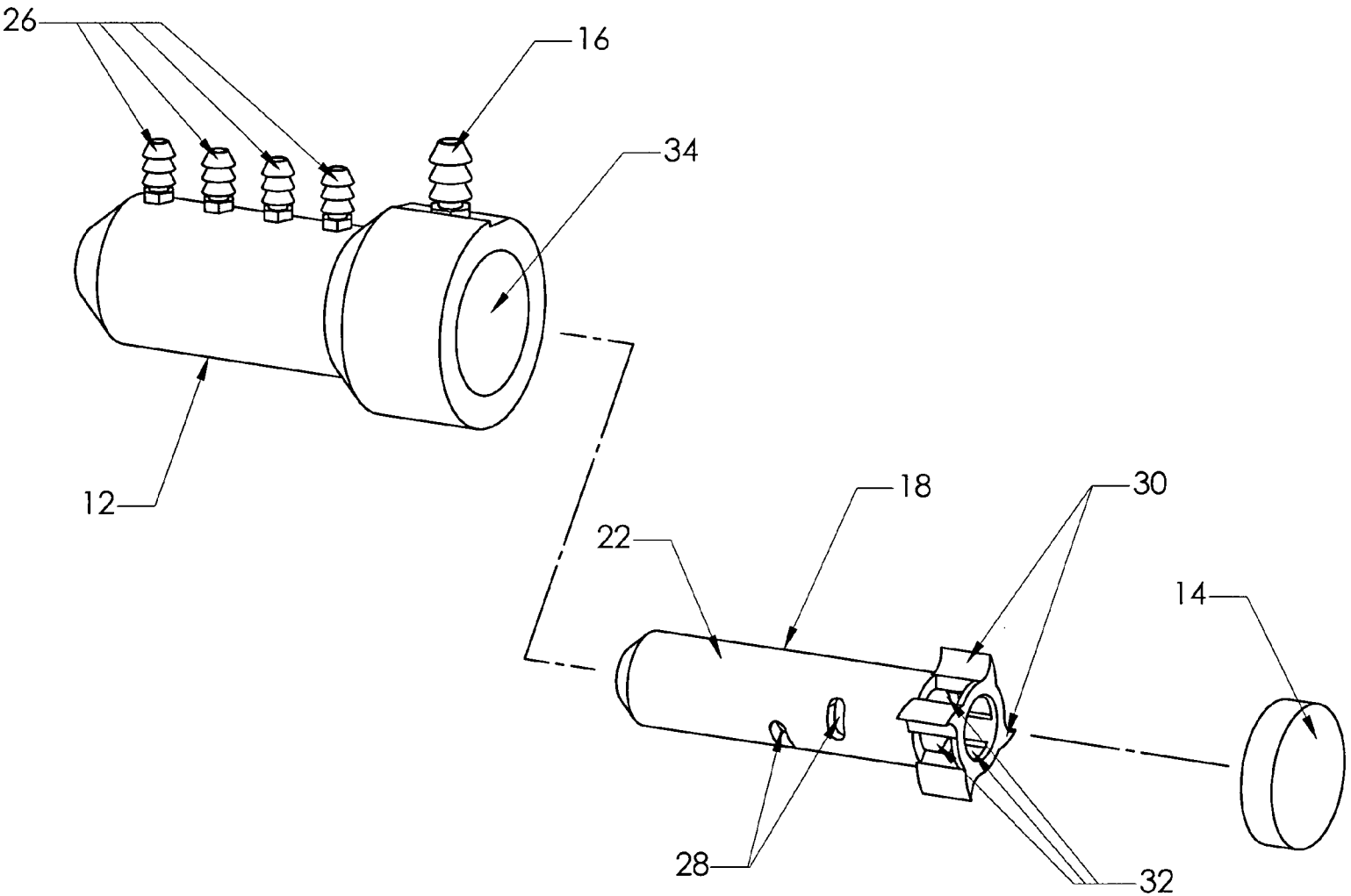
FIG. 2 is an exploded view, showing the parts of the present invention.

An exploded-parts view of distributing unit 10 is shown in FIG. 2. The reader will appreciate that turbine assembly 18 can be contained within main body interior 34 with the use of plug 14. Plug 14 can be attached to main body 12 in any desirable way, and can even be made detachable (such as by using threads to make it screw on and off). Turbine assembly 18 has impeller entry ports 32 located between impeller blades 30 which allow water to enter the inside of turbine assembly 18 when subjected to fluid flow through off-axis inlet port 36.

Figure 3:
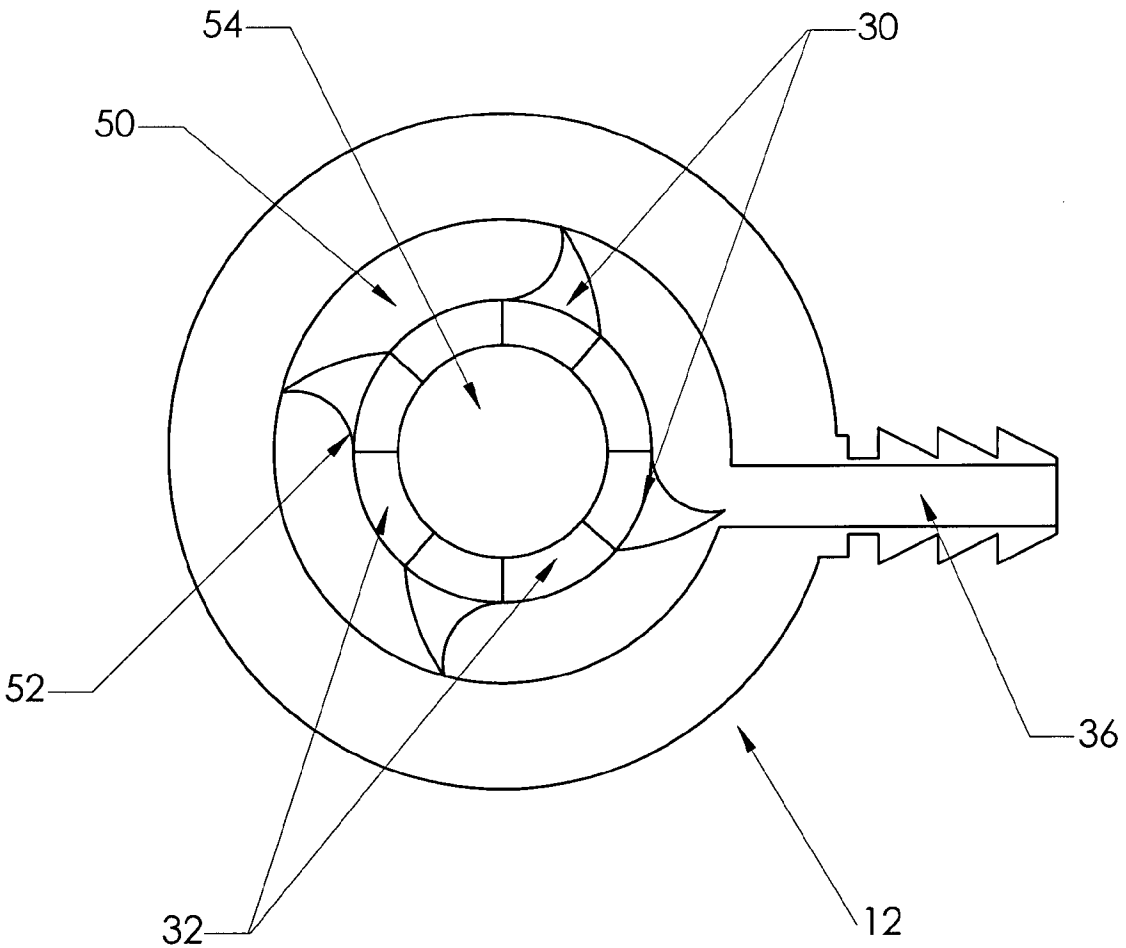
FIG. 3 is a cut-away view, showing the present invention.

A cut-away view of distributing unit 10 is provided in FIG. 3. The viewer will appreciate that when water flows in inlet port 36 it enters the annular flow space bounded by turbine head 52, main body 12, mating wall 50, and plug 14 (not shown here). Hydrodynamic forces provided by water flowing against blade face 58 and through impeller entry ports 32 cause turbine assembly to rotate in the clockwise direction. Some of the water immediately enters into impeller entry port 32, but some of the water travels further around the annular flow space before entering impeller other entry ports 32. Each impeller entry port 32 opens into turbine interior 54. Those that are skilled in the art will know that the water continues to travel in an approximately clockwise fashion as it travels down the length of turbine assembly 18 before exiting out axial outlet ports 24 (not shown here). Turbine head 52 mounts flush with mating wall 50 and creates an approximately water tight seal. This forces the water that enters inlet port 36 into turbine interior 54.

Figure 4:
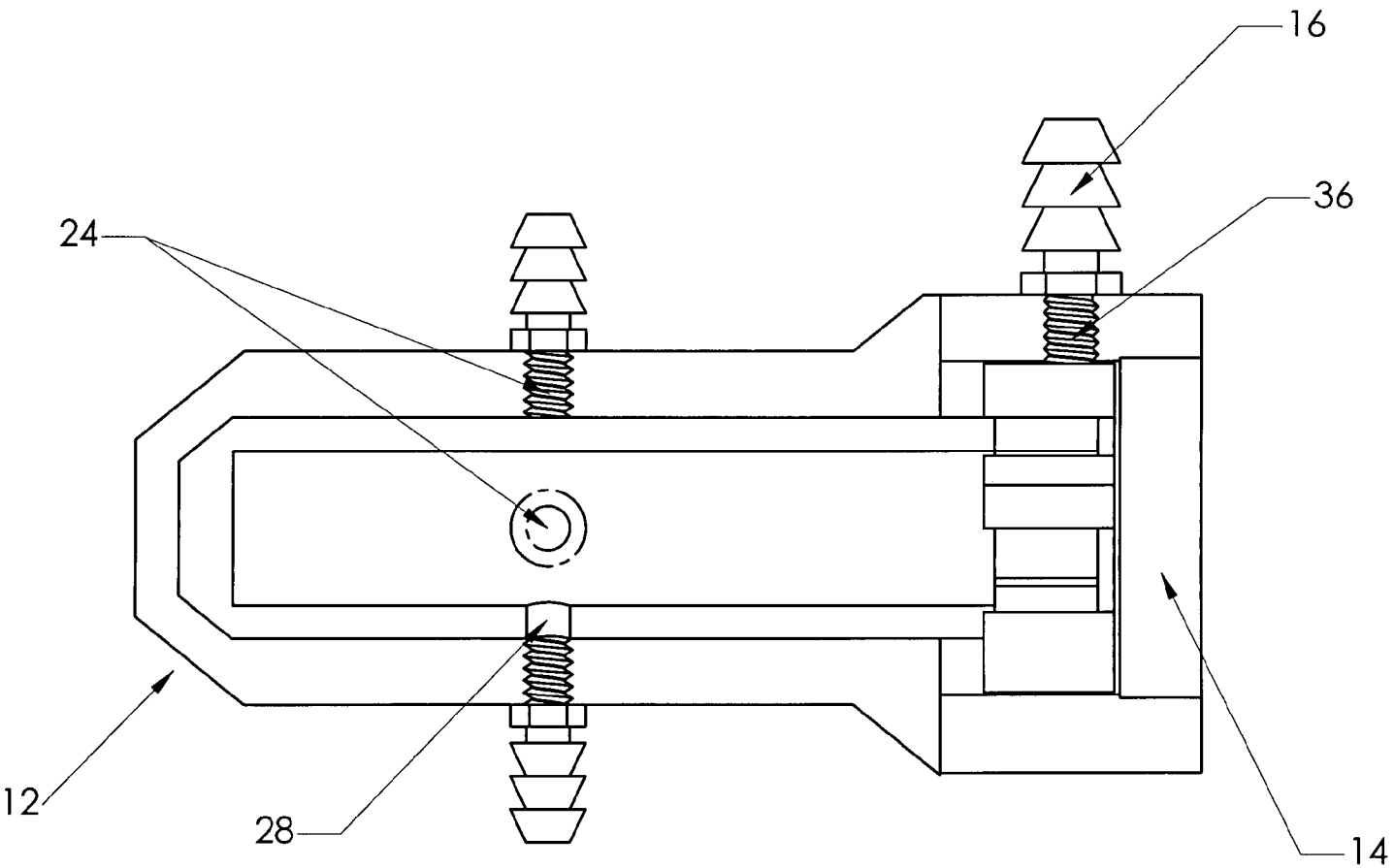
FIG. 4 is a section view, showing an alternate embodiment of the present invention.

An alternate embodiment of the present invention is shown in FIG. 4. This particular version of the invention utilizes only one metering discharge port 28 to service a plurality of axial outlet ports 24. Instead of employing plurality of axial outlet ports 24 down the length of main body 12, axial outlet ports 24 are arranged in a circle around the circumference of main body 12.

Figure 5:
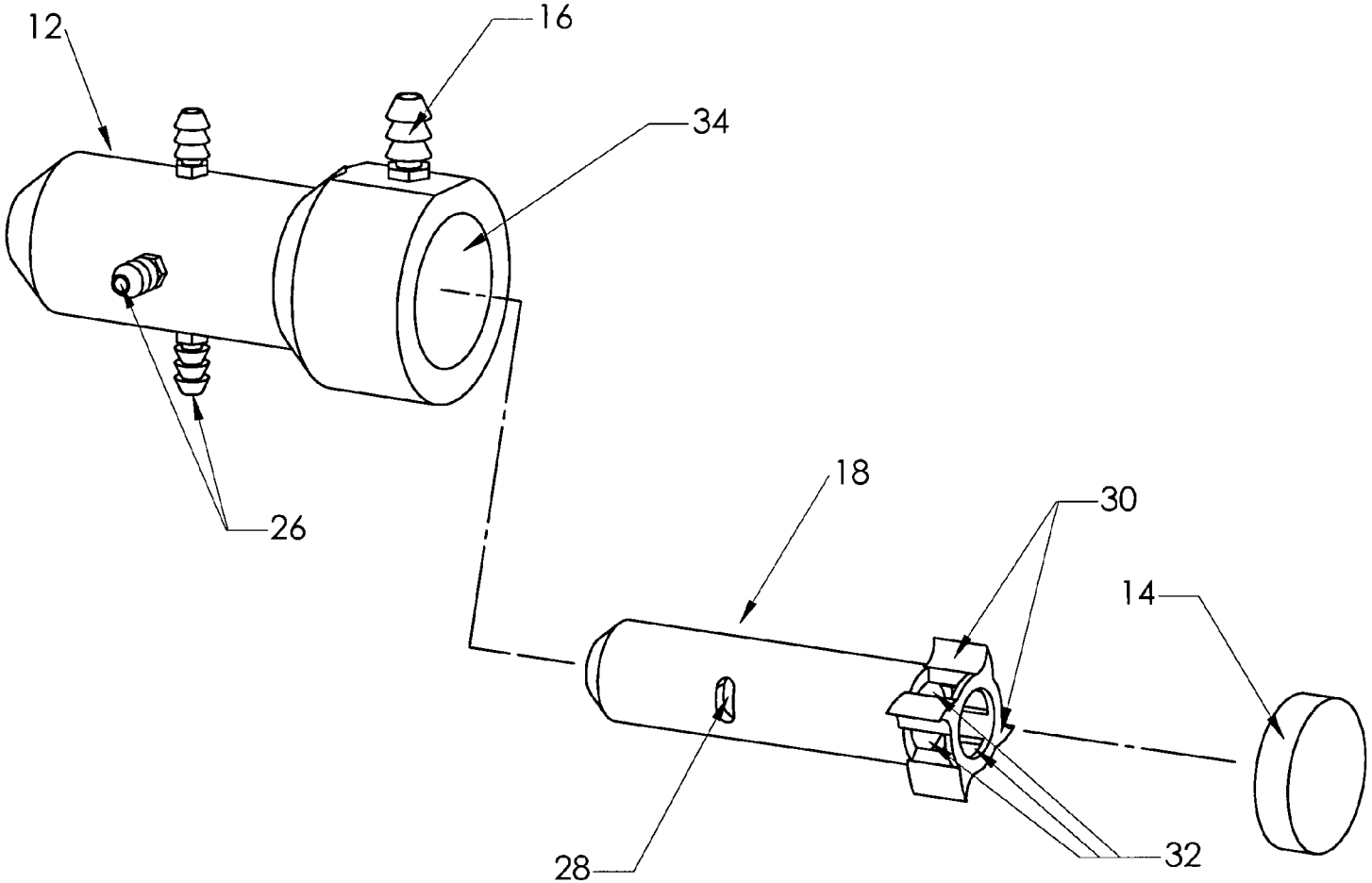
FIG. 5 is an exploded view, showing an alternate embodiment of the present invention.

An exploded-parts view of the alternate embodiment of distributing unit 10 is shown in FIG. 5. The alternate embodiment is very similar to the version shown in FIGS. 1, 2, and 3, except that a single metering discharge port 28 is used and hose barbs 26 are placed around the circumference of main body 12.

Figure 6:
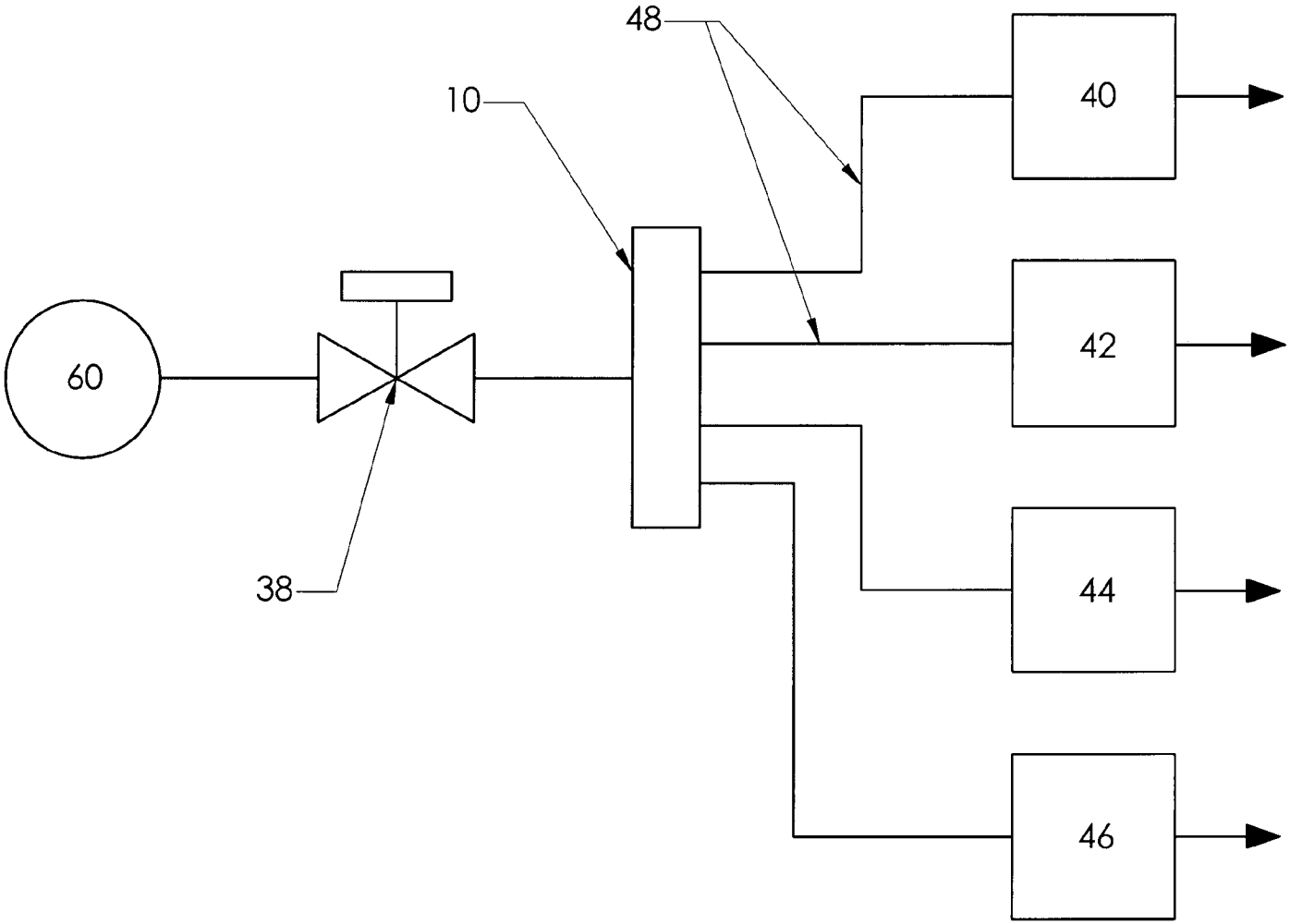
FIG. 6 is a flow diagram, showing the present invention integrated with an engine cooling system.

Distributing unit 10 can be installed in many ways. One example describing a system for the fresh water flushing of a marine engine's cooling system is provided in U.S. Pat. No. 5,393,252 to Douglas Brogdon and is incorporated herein by reference. In addition, a flow-diagram for a system utilizing distributing unit 10 is provided in FIG. 6. Control valve 38 can be used to actuate the flow of fresh water from fresh water source 60 to distributing unit 10. A control panel could be provided on the boat with a fresh water supply connector along with a handle that actuates control valve 38. Outlet hoses 48 are connected to each hose barb 26 at each axial outlet port 24. One outlet hose 48 can be attached to and allows for the fresh water flushing of sea water pickup pump 40. A second outlet hose 48 can be attached to and allows for the fresh water flushing of thermostat housing 42. A third and fourth outlet hose 48 can be attached to first tuned exhaust header 44 and second tuned exhaust header 46 for flushing of the exhaust headers.

Other arrangements for a flushing system are possible as well, and the aforementioned flow system is meant to provide only an example of how the distributing unit can be used as part of an integrated flushing system. The optimal placement locations for outlet hoses 48 varies with the marine engine for which flushing is desired.

One unique feature of the present invention is that it can be easily calibrated for optimal flushing of any marine engine cooling system. The quantity of axial outlet ports 24, the size of metering discharge ports 28, the dimensions of turbine assembly 18, and the locations on the cooling system where outlet hoses 48 are attached can all be changed as required for optimal flushing of a given marine engine and cooling system.

Those that are skilled in the art will know that making metering discharge port 28 larger when increase the volume of water in a given pulse. Different marine engines have different characteristics making it desirable to have a flushing system which can be calibrated for optimal flushing of specific engines. As an example, some marine engines have larger components to be cleaned. These engines may require larger pulses for optimal flushing than marine engines with smaller components.

The preceding description contains significant detail regarding the novel aspects of the present invention. It should not be construed, however, as limiting the scope of the invention but rather as providing illustrations of the preferred embodiments of the invention. As an example, many arrangements of metering discharge ports 28 and axial outlet ports 24 are possible. Such a variation would not alter the function of the invention. Thus, the scope of the invention should be fixed by the following claims, rather than by the examples given.

Having described my invention, I claim:

1. A pulsing water distribution valve for connecting a water source to a plurality of distribution lines, comprising:

a. a main body having a hollow main body interior;

b. a first outlet port connecting a first of said plurality of distribution lines to said hollow main body interior;

c. a second outlet port connecting a second of said plurality of distribution lines to said hollow main body interior;

d. an inlet port, connecting said water source to said hollow main body interior;

e. a turbine assembly, rotatably mounted within said hollow main body interior, including, i. a water turbine located proximate said inlet port so that water flowing from said water source through said inlet port rotates said water turbine;

ii. a distribution cylinder proximate said first and second outlet ports, attached to said water turbine and rotating in unison therewith;

iii. a hollow turbine interior within said turbine assembly, with said hollow turbine interior being fluidly connected to said inlet port;

iv. a first metering discharge port in said distribution cylinder fluidly connecting said hollow turbine interior with the exterior of said distribution cylinder; and v. a second metering discharge port in said distribution cylinder fluidly connecting said hollow turbine interior with the exterior of said distribution cylinder, and radially displaced from said first metering discharge port so that as said water turbine rotates, said first outlet port and said second outlet port will be sequentially connected to said hollow turbine interior.

2. A pulsing water distribution valve as recited in claim 1, further comprising:

a. a third outlet port connecting a third of said plurality of distribution lines to said hollow main body interior;

b. a third metering discharge port in said distribution cylinder fluidly connecting said hollow turbine interior with the exterior of said distribution cylinder, and radially displaced from said first and second metering discharge ports so that as said water turbine rotates, said first, second, and third outlet ports will be sequentially connected to said hollow turbine interior.

3. A pulsing water distribution valve as recited in claim 2, further comprising:

a. a fourth outlet port connecting a fourth of said plurality of distribution lines to said hollow main body interior;

b. a fourth metering discharge port in said distribution cylinder fluidly connecting said hollow turbine interior with the exterior of said distribution cylinder, and radially displaced from said first, second, and third metering discharge ports so that as said water turbine rotates, said first, second, third, and fourth outlet ports will be sequentially connected to said hollow turbine interior.

4. A pulsing water distribution valve as recited in claim 1, wherein said inlet port is placed in an off-axis orientation relative to said water turbine.

5. A pulsing water distribution valve as recited in claim 1, said water turbine further comprising at least one impeller blade with a blade face, wherein said blade face is positioned perpendicular to the flow of fluid through said inlet port.

6. A pulsing water distribution valve as recited in claim 1, said water turbine further comprising an impeller entry port opening into said hollow turbine interior.

7. A pulsing water distribution valve as recited in claim 1, further comprising:

a. a plug, said plug enclosing said turbine assembly within said hollow main body interior;

b. wherein said main body further includes a mating wall proximal to said water turbine;

c. wherein said plug, said main body, and said mating wall bound an annular flow space around said water turbine and force fresh water flowing through said inlet port to flow around said annular flow space and into said hollow turbine interior.

8. A pulsing water distribution valve as recited in claim 1, wherein said first of said plurality of distributing lines is also connected with an engine cooling system.

9. A pulsing water distribution valve as recited in claim 8, wherein said second of said plurality of distributing lines is also connected with said engine cooling system.

10. A pulsing water distribution valve for attachment to a flushing system for cleaning the cooling system of a marine engine comprising:

a. a main body having a hollow main body interior, said main body further comprising i. an inlet port;

ii. a plurality of axial outlet ports; and b. a turbine assembly having a hollow turbine interior, said turbine assembly further comprising i. an impeller, said impeller proximal to said inlet port so that water flowing through said inlet port causes said impeller to rotate;

ii. a distributing cylinder attached to said impeller and rotating in unison therewith;

iii. a first metering discharge port, said first metering discharge port opening into said hollow turbine interior; and c. wherein said turbine assembly is enclosed within said hollow main body interior.

11. The pulsing water distribution valve of claim 10, said turbine assembly further comprising a second metering discharge port, said second metering discharge port opening into said hollow turbine interior and radially displaced from said first metering discharge port so that as said water turbine rotates, said plurality of axial outlet ports will be sequentially connected to said hollow turbine interior.

12. The pulsing water distribution valve of claim 10, said impeller further comprising an impeller entry port, said impeller entry port opening into said hollow turbine interior.

13. The pulsing water distribution valve of claim 11, said impeller further comprising an impeller entry port, said impeller entry port opening into said hollow turbine interior.

14. The pulsing water distribution valve of claim 10, said impeller further comprising an impeller blade with a blade face, wherein said blade face is positioned perpendicular to the flow of fluid through said inlet port.

15. The pulsing water distribution valve of claim 11, said impeller further comprising an impeller blade with a blade face, wherein said blade face is positioned perpendicular to the flow of fluid through said inlet port.

16. The pulsing water distribution valve of claim 10, further comprising a plug, and a mating wall inside said hollow main body interior, wherein said plug, said main body, and said mating wall bound an annular flow space around said impeller and force fresh water flowing through said inlet port to flow around said annular flow space and into said hollow turbine interior.

17. The pulsing water distribution valve of claim 11, further comprising a plug, and a mating wall inside said hollow main body interior, wherein said plug, said main body, and said mating wall bound an annular flow space around said impeller and force fresh water flowing through said inlet port to flow around said annular flow space and into said hollow turbine interior.

18. The pulsing water distribution valve of claim 10, wherein said first metering discharge port cyclically aligns with at least one of said plurality of axial outlet ports when said turbine assembly rotates within said hollow main body interior, so that said first metering discharge port aligns with said at least one of said plurality of axial outlet ports each time said turbine assembly makes a complete rotation.

19. The pulsing water distribution valve of claim 10, further comprising a plurality of hoses, wherein each of said plurality of axial outlet ports is attached to a different one of each of said plurality of hoses, and each of said plurality of hoses is attached at a different location to said cooling system of said marine engine.

20. The pulsing water distribution valve of claim 10, wherein said inlet port is placed in an off-axis orientation relative to said impeller.

* * * * *